US005846142A

United States Patent [19]

Kakiuchi et al.

[11] Patent Number: 5,846,142

[45] Date of Patent: Dec. 8, 1998

[54] GOLF BALL

[75] Inventors: Shinichi Kakiuchi; Junji Umezawa, both of Chichibu, Japan

[73] Assignee: Bridgestone Corporation, Tokyo, Japan

[21] Appl. No.: 624,082

[22] Filed: Mar. 29, 1996

[30] Foreign Application Priority Data

Apr. 4, 1995 [JP] Japan ..... 7-103122

[51] Int. Cl.[6] ..... A63B 37/08

[52] U.S. Cl. ..... 473/354; 473/351; 473/378

[58] Field of Search ..... 473/365, 354, 473/378, 351

[56] References Cited

U.S. PATENT DOCUMENTS

| | | | |
|---|---|---|---|
| 2,259,060 | 10/1941 | Brown | 473/365 |
| 5,338,038 | 8/1994 | Cadorniga | 473/365 X |
| 5,445,387 | 8/1995 | Maruko et al. | 473/365 X |

*Primary Examiner*—George J. Marlo
*Attorney, Agent, or Firm*—Sughrue, Mion, Zinn, Macpeak & Seas, PLLC

[57] ABSTRACT

In a wound golf ball comprising a wound core having thread rubber wound on a center to form a thread rubber layer thereon and a cover around the wound core, the center has an optimum combination of a diameter A of 26–32 mm with a specific gravity D, the thread rubber layer is formed of inorganic filler-loaded thread rubber and has a specific gravity in the range of 0.93–1.05, and the cover is formed of an inorganic filler-loaded resin and has a specific gravity in the range of 1–1.4. The ball is improved in flying distance.

7 Claims, 2 Drawing Sheets

GOLF BALL

BACKGROUND OF THE INVENTION

1. Field of the Invention

This invention relates to a thread wound golf ball affording an increased flying distance.

2. Prior Art

In general, thread wound golf balls are manufactured by winding high tension thread rubber on a liquid or solid center to form a thread rubber layer thereon and enclosing the thread rubber layer with a cover of balata rubber or ionomer resin.

Major requirements for golf balls include flying distance and ease of ball control. As compared with two-piece golf balls, wound golf balls have the advantages of increased back spin, ease of control, and pleasant feel, but undesirably travel less distance because they tend to climb due to back spin.

It was desired in the prior art to develop a wound golf ball capable of traveling a longer flying distance. A number of proposals were made to achieve such improvement by adjusting the diameter and specific gravity of a center, the specific gravity of thread rubber and cover, and other factors.

As long as we have studied, reducing the diameter and specific gravity of a center will result in a lighter weight golf ball. This is avoided by blending an inorganic filler in the thread rubber layer or cover to increase the ball weight. However, if the amount of inorganic filler blended in thread rubber is increased, restitution is lost and rubber thread can be frequently snapped during winding. If the amount of inorganic filler blended in the cover is increased, penetration of the cover to the thread rubber layer is restrained, resulting in a ball which is susceptible to cracking and less durable against repetitive shots. None of the prior art approaches succeeded in increasing the flying distance of a wound golf ball without sacrificing other characteristics.

SUMMARY OF THE INVENTION

An object of the present invention is to provide a high performance wound golf ball which is improved in flying distance.

In order to increase the inertia moment of a wound golf ball to increase its flying distance, we investigated the relationship of the diameter and specific gravity of a center and the specific gravity of a thread rubber layer and a cover. We have found that by forming a center such that its diameter A and specific gravity D are in a specific range and blending an inorganic filler in thread rubber and a cover such that the thread rubber layer has a specific gravity of 0.93 to 1.05 and the cover has a specific gravity of 1 to 1.4, the wound golf ball can be increased in inertia moment by virtue of the synergistic effect of these parameters. Quite unexpectedly, the wound golf ball can be reduced in spin receptivity and increased in flying distance without sacrificing ease of control and other advantages.

Accordingly, the present invention provides a wound golf ball comprising a wound core having thread rubber wound on a center to form a thread rubber layer thereon and a cover around the wound core. The ball meets the following requirements (1) to (3). (1) The center has a diameter A of 26 to 32 mm and a specific gravity D which satisfy the following relationship.

$$1.0 \leqq D \leqq -0.9446 \times A + 0.0215 \times A^2 - 0.00014 \times A^3 + 14.12$$

(2) The thread rubber layer is formed of inorganic filler-loaded thread rubber and has a specific gravity of 0.93 to 1.05. (3) The cover is formed of an inorganic filler-loaded resin and has a specific gravity of 1 to 1.4.

DETAILED DESCRIPTION OF THE INVENTION

Figure 1:
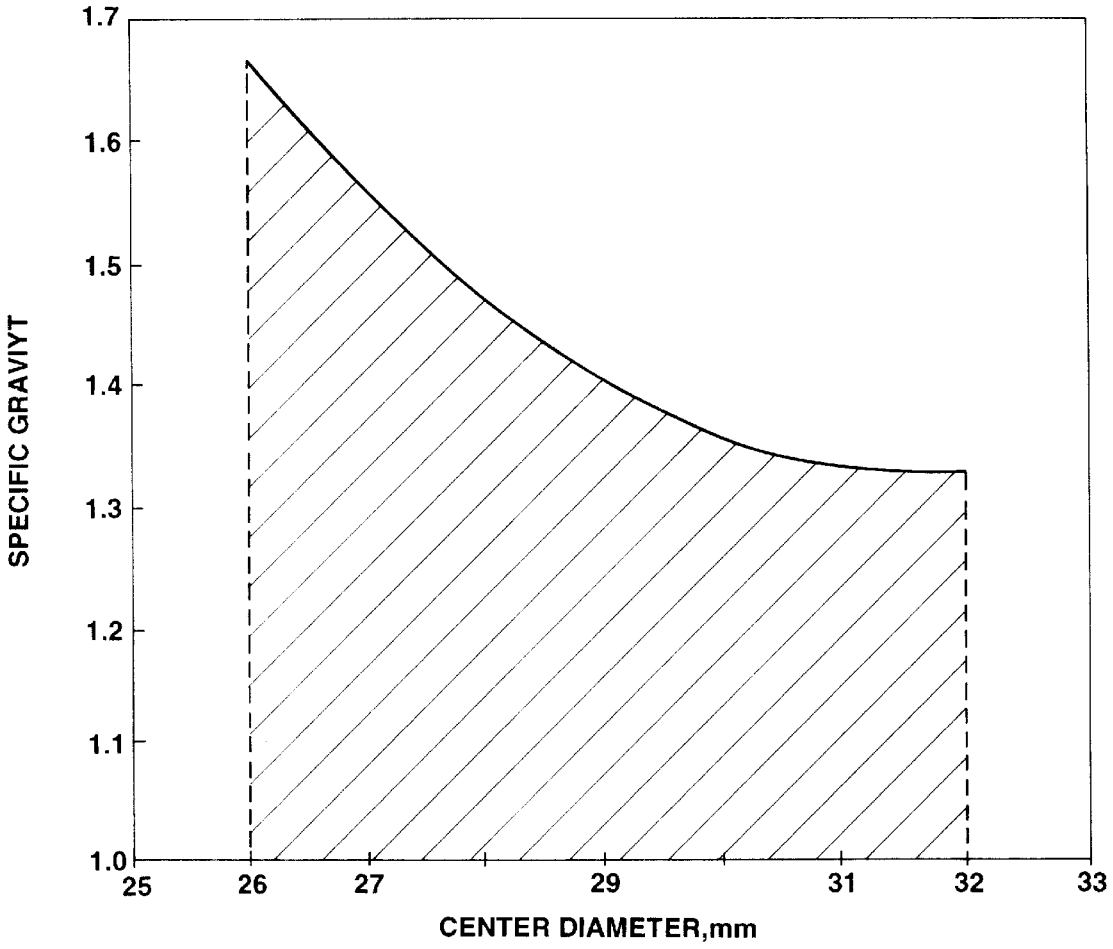
FIG. 1 is a graph showing the specific gravity versus diameter of a center of a wound golf ball.
Figure 2:
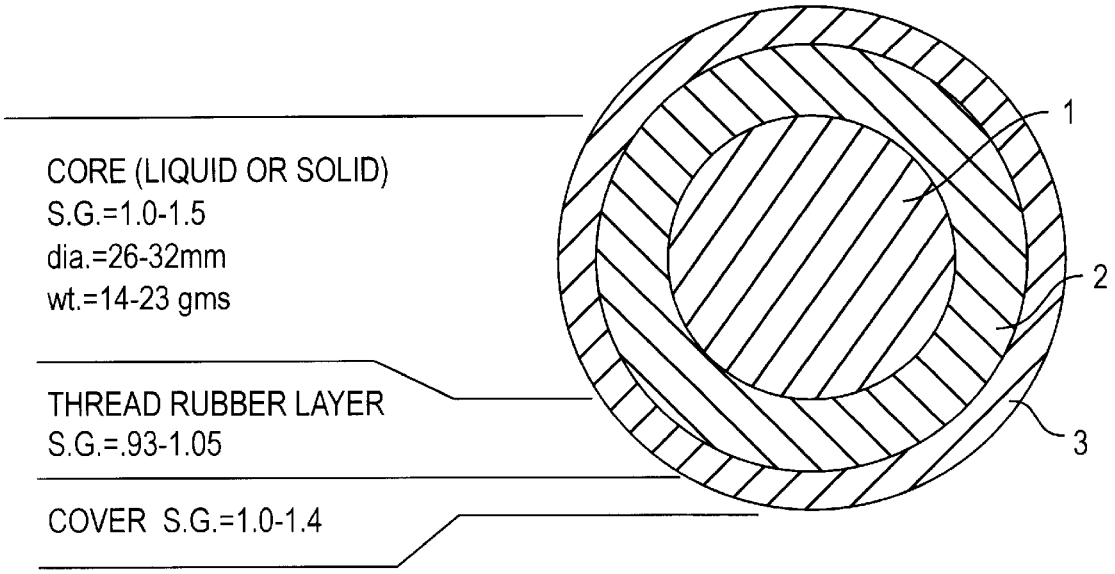
FIG. 2 is a cut away view of a golf ball in accordance with this invention.

For the purpose of increasing an inertia moment and hence, a flying distance, the wound golf ball of the invention must meet requirement (1) regarding its center. Provided that the center 1 has a diameter A and a specific gravity D, the center is formed such that A and D fall in the shaded area in the graph of FIG. 1 where the specific gravity D is plotted relative to the diameter A of a center. That is, the center diameter A is 26 to 32 mm an d A and D satisfy the following equation.

$$1.0 \leqq D \leqq -0.9446 \times A + 0.0215 \times A^2 - 0.00014 \times A^3 + 14.12$$

Within this range, the resulting golf ball exhibits satisfactory performance.

Therefore, the center of the wound golf ball of the invention should have a diameter of 26 to 32 mm, preferably 28 to 31 mm. A center diameter of less than 26 mm results in an increased spin rate and a reduced flying distance. With a center diameter of more than 32 mm, an appropriate ball hardness is barely achievable. The center specific gravity should be at least 1 and within the range defined by the above equation, preferably 1.20 to 1.50. Preferably the center has a weight of 14 to 23 grams.

In the practice of the invention, the center may be either a liquid center or a solid center. These centers may be prepared from well known materials in a well-known manner. The invention is more effective with liquid centers. The liquid center consists of a hollow spherical center bag made of rubber, for example, and a fill liquid such as water. The center bag may be made of a conventional composition comprising a rubber component such as natural rubber, butadiene rubber, isoprene rubber and mixtures thereof, an inorganic filler for specific gravity adjustment, a vulcanizing agent such as sulfur, a vulcanization promoter, process oil and stearic acid. The inorganic filler used herein is not critical and may be selected from fillers commonly used in bag-forming rubber, for example, zinc white, barium sulfate, calcium carbonate, and silica, with the zinc white being preferred. The liquid with which the center bag is filled may be selected from well-known liquids, for example, water and mixtures of water with barium sulfate, sodium sulfate or ethylene glycol.

The wound golf ball of the invention must meet requirement (2) that the thread rubber layer 2 has a specific gravity of 0.93 to 1.05, preferably 0.95 to 1.00. The advantages of the invention are not fully obtained if the thread rubber layer's specific gravity is less than 0.93. If the thread rubber layer's specific gravity is more than 1.05, the resulting golf ball is reduced in restitution and rubber thread can be frequently snapped during winding.

The thread rubber layer 2 having a specific gravity in the specified range is formed by blending a proper amount of an inorganic filler in thread rubber. The inorganic filler used herein is selected from the same fillers as mentioned above, preferably zinc white. In addition to the inorganic filler, other well-known additives may be added to the thread rubber. For example, a rubber component such as natural rubber, butadiene rubber, isoprene rubber and mixtures thereof may be blended with a vulcanizing agent such as sulfur, a vulcanization promoter, and stearic acid.

Any conventional technique may be used for winding. Thread rubber is wound around the center under high tension until the wound core reaches an outer diameter of 38.5 to 40.5 mm. The size of thread rubber used is not critical although it generally has a width of about 1.5 to 2.0 mm and a thickness of 0.40 to 0.55 mm.

The wound golf ball of the invention must meet requirement (3) that the cover 3 has a specific gravity of 1.0 to 1.4. The advantages of the invention are not fully obtained if the cover's specific gravity is less than 1.0. If the cover's specific gravity is more than 1.4, penetration of the cover to the thread rubber layer is restrained, resulting in a ball which is susceptible to cracking and less durable against repetitive shots.

The cover 3 having a specific gravity in the specified range is formed by blending a proper amount of an inorganic filler in a base component. The inorganic filler used herein is selected from the same fillers as mentioned above, preferably zinc white. The base component of the cover may be any well-known component, typically balata rubber and ionomer resin. Preferably the cover has a radial thickness of 1.0 to 2.5 mm, especially 1.2 to 2.0 mm and a hardness of 70 to 93 on JIS C scale.

The cover 3 may consist of a single layer or plural layers. In the case of a multilayer cover, the thickness of the respective layers may be properly selected in accordance with a particular layered structure. Any conventional technique may be used for forming the cover. For example, a cover is advantageously formed by placing the wound core in a mold and injection molding the cover-forming resin composition around the core. A compression molding technique using half shells is also acceptable.

The wound golf ball thus completed should have a diameter and weight complying with the Rules of Golf, namely a diameter of at least 42.67 mm and a weight of up to 45.92 grams. From the standpoints of hitting feel, restitution and durability, the ball preferably has a hardness such that its distortion under a load of 100 kg is 2.6 to 3.6 mm.

There has been described a thread wound golf ball which is increased in flying distance without sacrificing ease of control and other advantages.

EXAMPLE

Examples of the present invention are given below by way of illustration and not by way of limitation.

Examples 1–6 & Comparative Examples 1–4

Wound golf balls were prepared by forming a liquid center, thread rubber layer and cover from the compositions shown in Tables 1, 2, 3, respectively, and combining them according to Table 4 (center diameter 30 mm) or Table 5 (center diameter 28 mm). The balls were evaluated for ball hardness, penetration depth, flying performance, and durability by the tests described below. The results are shown in Tables 4 and 5.

TABLE 1

| | A | B | C | D | E |
|---|---|---|---|---|---|
| Center bag composition | | | | | |
| Natural rubber | 100 | 100 | 100 | 100 | 100 |
| Zinc white | 145 | 90 | 40 | 240 | 165 |
| Process oil | 25 | 15 | — | 30 | 25 |
| Stearic acid | 1.0 | 1.0 | 1.0 | 1.0 | 1.0 |
| Vulcanization promoter + Sulfur | 4.0 | 4.0 | 4.0 | 4.0 | 4.0 |
| Center bag | | | | | |
| Specific gravity | 1.67 | 1.46 | 1.20 | 2.01 | 1.76 |
| Hardness (JIS A) | 56 | 55 | 53 | 58 | 57 |
| Gage (mm) | 2.3 | 2.3 | 2.3 | 2.3 | 2.3 |
| Liquid | 20% sodium sulfate aqueous solution | | | | |
| Liquid center | | | | | |
| weight (gram) | 19.6 | 18.5 | 17.2 | 16.8 | 15.6 |
| Outer diameter (mm) | 30 | 30 | 30 | 28 | 28 |
| Specific gravity | 1.38 | 1.31 | 1.22 | 1.46 | 1.36 |

TABLE 2

| | A | B | C | D |
|---|---|---|---|---|
| Thread rubber composition | | | | |
| Isoprene rubber | 70 | 70 | 70 | 70 |
| Natural rubber | 30 | 30 | 30 | 30 |
| Zinc white | 1.5 | 10.0 | 15.0 | 22.0 |
| Stearic acid | 1.0 | 1.0 | 1.0 | 1.0 |
| Vulcanization promoter + Sulfur | 2.6 | 2.6 | 2.6 | 2.6 |
| Specific gravity | 0.93 | 1.00 | 1.03 | 1.08 |

TABLE 3

| | A | B | C | D |
|---|---|---|---|---|
| Balata cover composition | | | | |
| Synthetic trans-polyisoprene rubber | 80 | 80 | 80 | 80 |
| High-impact styrene resin | 10 | 10 | 10 | 10 |
| Natural rubber | 10 | 10 | 10 | 10 |
| Zinc white | 10 | 33 | 39 | 60 |
| Titanium oxide | 10 | 10 | 10 | 10 |
| Stearic acid | 1.0 | 1.0 | 1.0 | 1.0 |
| Vulcanization promoter + Sulfur | 1.5 | 1.5 | 1.5 | 1.5 |
| Specific gravity | 1.10 | 1.21 | 1.27 | 1.45 |

Ball hardness

Hardness is expressed by a distortion (mm) of a ball under a load of 100 kg.

Penetration depth

A ball was disintegrated. The thread rubber was unwound until adhesion of the cover material became unperceivable. The outer diameter was measured at this point. The penetration depth is the initial thread rubber layer outer diameter of 40 mm minus this outer diameter.

Flying Test

Using a swing robot, sample balls (n=12 for each Example) were hit by a driver (W#1) at a head speed (HS) of 45 m/s to measure a carry and a total flying distance. Under this hitting condition, an initial velocity, spin and elevation angle were measured. An average of 12 balls is reported.

Durability

Using a swing robot, sample balls (n=20 for each Example) were hit at a head speed of 48 m/sec. against a target plate. Impact hitting was repeated 100 times to determine whether or not the balls were deformed. The number of intact balls is reported in Tables 4 and 5 based on an index of 100 for Comparative Example 1.

TABLE 4

| | E1 | E2 | E3 | E4 | CE1 | CE2 | CE3 |
|---|---|---|---|---|---|---|---|
| Center | | | | | | | |
| Type | B | B | C | C | A | C | C |
| Outer diameter (mm) | 30 | 30 | 30 | 30 | 30 | 30 | 30 |
| Specific gravity | 1.31 | 1.31 | 1.22 | 1.22 | 1.38 | 1.22 | 1.22 |
| Thread rubber | | | | | | | |
| Type | B | A | C | B | A | A | D |
| Specific gravity | 1.00 | 0.93 | 1.03 | 1.00 | 0.93 | 0.93 | 1.08 |
| Thread rubber layer | | | | | | | |
| Weight (g) | 17.9 | 17.1 | 18.7 | 18.2 | 17.4 | 17.1 | 19.8 |
| Volume ($cm^3$) | 21.0 | 20.9 | 20.8 | 21.0 | 21.2 | 21.0 | 21.0 |
| Density ($g/cm^3$) | 0.85 | 0.82 | 0.90 | 0.86 | 0.82 | 0.82 | 0.94 |
| Penetration depth (mm) | 2.2 | 2.0 | 2.0 | 1.9 | 2.3 | 1.6 | 2.3 |
| Cover | | | | | | | |
| Type | A | C | B | C | A | D | A |
| Specific gravity | 1.10 | 1.27 | 1.21 | 1.27 | 1.10 | 1.45 | 1.10 |
| Ball | | | | | | | |
| Outer diameter (mm) | 42.67 | 42.67 | 42.68 | 42.68 | 42.67 | 42.68 | 42.68 |
| Weight (g) | 45.2 | 45.3 | 45.2 | 45.2 | 45.1 | 45.2 | 45.2 |
| Hardness (mm) | 3.00 | 3.02 | 2.96 | 3.05 | 3.00 | 2.95 | 2.98 |
| W#1/HS 45 m/s | | | | | | | |
| Initial velocity (m/s) | 65.6 | 65.5 | 65.3 | 65.4 | 65.5 | 65.4 | 65.0 |
| Spin (rpm) | 3100 | 3110 | 3050 | 3080 | 3250 | 3090 | 3080 |
| Elevation angle (°) | 12.5 | 12.4 | 12.3 | 12.5 | 12.5 | 12.4 | 12.2 |
| Carry (m) | 209.5 | 209.3 | 209.0 | 209.7 | 210.0 | 209.5 | 206.8 |
| Total (m) | 228.1 | 227.9 | 228.6 | 229.1 | 225.4 | 229.7 | 222.3 |
| Durability | 100 | 100 | 100 | 95 | 100 | 60 | 100 |

TABLE 5

| | E5 | E6 | CE4 |
|---|---|---|---|
| Center | | | |
| Type | E | E | D |
| Outer diameter (mm) | 28 | 28 | 28 |
| Specific gravity | 1.36 | 1.36 | 1.46 |
| Thread rubber | | | |
| Type | B | A | A |
| Specific gravity | 1.00 | 0.93 | 0.93 |
| Thread rubber layer | | | |
| Weight (g) | 21.1 | 20.0 | 19.9 |
| Volume ($cm^3$) | 23.3 | 23.4 | 23.3 |
| Density ($g/cm^3$) | 0.91 | 0.85 | 0.85 |
| Penetration depth (mm) | 2.3 | 2.0 | 2.3 |
| Cover | | | |
| Type | A | C | A |
| Specific gravity | 1.10 | 1.27 | 1.10 |
| Ball | | | |
| Outer diameter (mm) | 42.68 | 42.68 | 42.67 |
| Weight (g) | 45.3 | 45.1 | 45.2 |
| Hardness (mm) | 2.80 | 2.83 | 2.78 |
| W#1/HS 45 m/s | | | |
| Initial velocity (m/s) | 65.5 | 65.4 | 65.5 |

TABLE 5-continued

| | E5 | E6 | CE4 |
|---|---|---|---|
| Spin (rpm) | 3230 | 3210 | 3350 |
| Elevation angle (°) | 12.4 | 12.4 | 12.5 |
| Carry (m) | 207.3 | 207.0 | 207.5 |
| Total (m) | 224.1 | 224.3 | 221.1 |
| Durability | 100 | 100 | 100 |

As is evident from Tables 4 and 5, the balls of Comparative Examples 1 and 4 have an increased spin rate, the ball of Comparative Example 2 having a too heavy cover is less durable, and the ball of Comparative Example 3 having a too heavy thread rubber layer is low in restitution. In contrast, the wound golf balls of the invention (Examples 1–6) have an improved initial velocity, a high elevation angle and reduced spin upon hitting and thus travel a longer distance. The inventive balls are more durable due to the improved penetration of the cover into the thread rubber layer. The inventive balls are of high quality.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A wound golf ball comprising a wound core having thread rubber wound on a center to form a thread rubber layer thereon and a cover around the wound core, wherein said center is a liquid center having a diameter A in the range of 26 to 32 mm and a specific gravity D which satisfy the relationship:

$$1.20 \leqq D \leqq -0.9446 \times A + 0.0215 \times A^2 - 0.00014 \times A^3 + 14.12,$$

where the specific gravity D is in the range of 1.20 to 1.50 said thread rubber layer is formed of thread rubber loaded with an inorganic filler such that the thread rubber layer has a specific gravity of 0.95 to 1.05, and said cover is formed of a resin loaded with an inorganic filler such that the cover has a specific gravity of 1.1 to 1.4.

2. The wound golf ball of claim 1 wherein the inorganic filler is zinc white.

3. The wound golf ball of claim 1 wherein the liquid center has a weight in the range of 14 to 23 grams.

4. The wound golf ball of claim 1 wherein the liquid center comprises a hollow spherical center bag made of rubber and filled with water.

5. The wound golf ball of claim 1 wherein said cover has a radial thickness in the range of 1.0 to 2.55 mm.

6. The wound golf ball of claim 1 wherein said cover has a hardness in the range of 70 to 93, JIS C.

7. The wound golf ball of claim 1 wherein said ball has a hardness such that its distortion under an applied load of 100 kg is in the range of 2.6 to 3.6 mm.

* * * * *

UNITED STATES PATENT AND TRADEMARK OFFICE

CERTIFICATE OF CORRECTION

PATENT NO. : 5,846,142 
APPLICATION NO. : 08/624082
DATED : December 8, 1998
INVENTOR(S) : Shinichi Kakuichi and Junji Umezawa It is certified that error appears in the above-identified patent and that said Letters Patent is hereby corrected as shown below:

On the title page:
Item [73] Assignee, delete "Bridgeston Corporation" and insert --Bridgestone Sports Co., Ltd.--

Signed and Sealed this

Fifth Day of December, 2006

JON W. DUDAS
*Director of the United States Patent and Trademark Office*